US011181259B2

(12) United States Patent
Wang

(10) Patent No.: US 11,181,259 B2
(45) Date of Patent: Nov. 23, 2021

(54) ILLUMINATION MODULE AND ILLUMINATION DEVICE

(71) Applicants: OPPLE LIGHTING CO., LTD., Shanghai (CN); SUZHOU OPPLE LIGHTING CO., LTD., Suzhou (CN)

(72) Inventor: Xiaolei Wang, Shanghai (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 17/100,782

(22) Filed: Nov. 20, 2020

(65) Prior Publication Data

US 2021/0071858 A1 Mar. 11, 2021

Related U.S. Application Data

(63) Continuation of application No. PCT/CN2019/086669, filed on May 13, 2019.

(30) Foreign Application Priority Data

May 21, 2018 (CN) ..... 201810490379.7
May 21, 2018 (CN) ..... 201820757318.8

(51) Int. Cl.
*F21V 23/06* (2006.01)
*F21V 5/04* (2006.01)
(Continued)

(52) U.S. Cl.
CPC ..... *F21V 23/06* (2013.01); *F21V 5/04* (2013.01); *F21V 21/096* (2013.01); *F21Y 2115/10* (2016.08)

(58) Field of Classification Search
None
See application file for complete search history.

(56) References Cited

U.S. PATENT DOCUMENTS 8,662,734 B2 * 3/2014 Covaro ..... H01R 25/16 362/648
2010/0118532 A1 5/2010 Liang et al.
(Continued)

FOREIGN PATENT DOCUMENTS

CN 205101960 U 3/2016
CN 205956792 U 2/2017
CN 108488703 A 9/2018

OTHER PUBLICATIONS

International Search Report of PCT Application No. PCT/CN2019/086669 dated Aug. 8, 2019, (4p).

*Primary Examiner* — Britt D Hanley
(74) *Attorney, Agent, or Firm* — Arch & Lake LLP

(57) ABSTRACT

The present disclosure provides an illumination module and an illumination device. The illumination module includes a bottom case, a shield buckled coupled with the bottom case to form an accommodation cavity, a lens and a polygonal substrate provided with a light source which are arranged in the accommodation cavity, the lens being configured to distribute light beams emitted from the light source, where the bottom case has a plurality of side walls, an outer side of each of the plurality of side walls is mounted with a first magnetic component, and the first magnetic component is configured to connect two illumination modules by attraction; each side of the polygonal substrate is provided with an electrical connection interface; and upon the electrical connection interface of the illumination module being plugged into an electrical connection interface of another illumination module, an electrical connection between the two illumination modules is realized.

18 Claims, 4 Drawing Sheets

(51) Int. Cl.
*F21V 21/096* (2006.01)
*F21Y 115/10* (2016.01)

(56) References Cited

U.S. PATENT DOCUMENTS

2012/0182739 A1* 7/2012 Leung ..... F21S 2/005
362/249.06
2013/0163234 A1* 6/2013 Hsien ..... F21V 21/005
362/190

* cited by examiner

ILLUMINATION MODULE AND ILLUMINATION DEVICE

CROSS-REFERENCE TO RELATED APPLICATIONS

This application is based upon and claims the priority of PCT patent application No. PCT/CN2019/086669 filed on May 13, 2019 which claims priority to the Chinese patent application No. 201820757318.8 filed on May 21, 2018 and the Chinese patent application No. 201810490379.7 filed on May 21, 2018, the entire content of all of which is hereby incorporated by reference herein for all purposes.

TECHNICAL FIELD

The present disclosure relates to a technical field of illumination, and particularly relates to an illumination module, an illumination device, and a method of manufacturing an illumination module.

BACKGROUND

An illumination device serves as an indispensable part of daily life, work and study. The characteristics of an illumination device such as energy saving, convenience of installation and aesthetics, and the like need to be continuously improved in the development of illumination technology.

SUMMARY

The present disclosure provides an illumination module, an illumination device and a method of manufacturing an illumination module.

According to an aspect of the present disclosure, an illumination module is provided. The illumination module may include a bottom case, a shield buckled coupled with the bottom case to form an accommodation cavity, a lens and a polygonal substrate provided with a light source which are arranged in the accommodation cavity, the lens being configured to distribute light beams emitted from the light source.

The bottom case may have a plurality of side walls, an outer side of each of the plurality of side walls is mounted with a first magnetic component, and the first magnetic component is configured to connect any two of the illumination modules by attraction; each side of the polygonal substrate may be provided with an electrical connection interface, each of the plurality of side walls of the bottom case may be provided with a notch, and the electrical connection interface is placed in the notch; and upon the electrical connection interface of the illumination module being plugged into an electrical connection interface of another illumination module, an electrical connection between the two illumination modules is realized, and the opposite first magnetic components on the two illumination modules may be attached.

According to another aspect of the present disclosure, an illumination device is provided. The device may include at least two illumination modules, where one illumination module of the at least two illumination modules may include: a bottom case, a shield buckled coupled with the bottom case to form an accommodation cavity, a lens and a polygonal substrate provided with a light source which are arranged in the accommodation cavity, the lens being configured to distribute light beams emitted from the light source.

The bottom case may have a plurality of side walls, an outer side of each of the plurality of side walls may be mounted with a first magnetic component, and the first magnetic component may be configured to connect any two of the illumination modules by attraction; each side of the polygonal substrate may be provided with an electrical connection interface, each of the plurality of side walls of the bottom case may be provided with a notch, and the electrical connection interface may be placed in the notch; upon the electrical connection interface of the illumination module being plugged into an electrical connection interface of another illumination module, an electrical connection between the two illumination modules is realized, and the opposite first magnetic components on the two illumination modules are attached.

The at least two illumination modules may be spliced together, where the first magnetic components on the side walls of two adjacent bottom cases in any two adjacent illumination modules may be mutually attached to realize a mechanical connection between the any two adjacent illumination modules; and the electrical connection interface of one of the any two adjacent illumination modules may be plugged into the electrical connection interface of the other one of the any two adjacent illumination modules to realize an electrical connection between the any two adjacent illumination modules.

According to a further aspect of the present disclosure, a method of manufacturing an illumination module is provided. The method may include providing a bottom case; forming an accommodation cavity by coupling a shield buckled with the bottom case; providing a lens and a polygonal substrate that are provided with a light source which are arranged in the accommodation cavity, where the lens may be configured to distribute light beams emitted from the light source; providing a plurality of side walls for the bottom case, where an outer side of each of the plurality of side walls may be mounted with a first magnetic component, and the first magnetic component is configured to connect any two of the illumination modules by attraction; providing each side of the polygonal substrate with an electrical connection interface, where each of the plurality of side walls of the bottom case may be provided with a notch, and the electrical connection interface is placed in the notch; and upon the electrical connection interface of the illumination module being plugged into an electrical connection interface of another illumination module, providing an electrical connection between the two illumination modules, and attaching the opposite first magnetic components on the two illumination modules.

It is to be understood that both the foregoing general description and the following detailed description are exemplary and explanatory only and are not restrictive of the present disclosure.

BRIEF DESCRIPTION OF THE DRAWINGS

The accompanying drawings described herein are intended to provide a further understanding of the present disclosure, and constitute a part of the disclosure, illustrative examples of the disclosure and together with the description serve to explain the disclosure, and constitute no undue limitation to the present disclosure. In the accompanying drawings.

DETAILED DESCRIPTION

In order to enable those skilled in the art to better understand the technical solutions in the present disclosure, the technical solutions in the examples of the present disclosure will be described in a clearly and fully way in connection with the drawings related to the examples of the present disclosure. Apparently, the described examples are just a part but not all of the examples of the present disclosure. Based on the described examples herein, those skilled in the art can obtain other example(s), without any inventive work, which should be within the protection scope of the present disclosure.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Many illumination devices are designed and produced by manufacturers and then sold; and the fixed shape of the illumination device after being manufactured is determined in the design stage; therefore, consumers cannot change the effect presented by the illumination device according to different personal preferences.

There are some illumination modules with a equilateral triangle shape or a square shape, and the like, which can be combined and connected, on the market at present, but the electrical connection and mechanical connection between the illumination devices cannot be realized conveniently, quickly and reliably. Moreover, once the combined illumination devices are fixedly installed on the wall, it is easy to damage the wall if they are disassembled. Therefore, there is a need to develop an illumination device which has efficient, convenient and quick splicing manner and installation manner.

Figure 1:
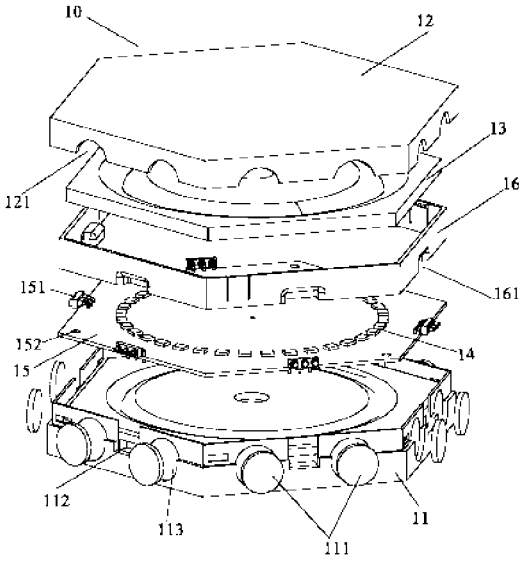
FIG. 1 shows an exploded structural schematic diagram of an illumination module according to an example of the present disclosure.
Figure 2:
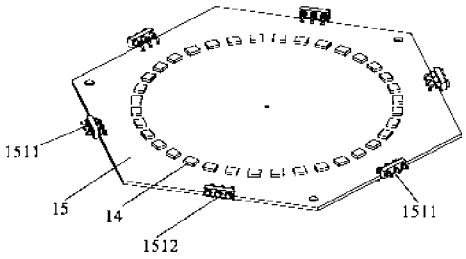
FIG. 2 shows a structural schematic diagram of a polygonal substrate and an electrical connection interface which are combined according to an example of the present disclosure.

An example of the present disclosure provides an illumination module 10. Referring to FIGS. 1 and 2, the illumination module 10 can at least include a bottom case 11, a shield 12, a lens 13, and a polygonal substrate 15 amounted with a light source 14 (e.g., an LED light source, etc.), wherein the bottom case 11 is buckled with the shield 12 to form an accommodation cavity for accommodating the lens 13 and the polygonal substrate 15; and the lens 13 distributes light beams emitted from the light source 14.

In the present example, the bottom case 11 has a plurality of side walls; and at an outer side of each side wall is mounted with a first magnetic component 111; the first magnetic component 111 is configured to connect any two illumination modules by attraction. In addition, each side of the polygonal substrate 15 is provided with an electrical connection interface 151; each side wall of the bottom case 11 is provided with a notch 112; each electrical connection interface 151 is placed in a corresponding notch 112; and the electrical connection interfaces 151 of any one illumination module can be plugged into the electrical connection interfaces 151 of another illumination module through the notch 112 to realize an electrical connection between the two illumination modules. At the same time, the opposite first magnetic components 111 on the two illumination modules are mutually attracted and attached; that is, after the two illumination modules are electrically connected, the first magnetic components 111 on the adjacent side walls attract each other to realize a mechanical connection between the two illumination modules. FIG. 1 and FIG. 2 of the present example show a hexagonal substrate. In fact, the polygonal substrate 15 can have any shape, such as triangle, quadrilateral, pentagon, etc., without being specifically limited here. The shapes of the bottom case 11, the shield 12, the bottom surface of the lens 13, etc., can also be shapes corresponding to that of the polygonal substrate 15.

With reference to FIG. 1 and FIG. 2, in an example of the present disclosure, the electrical connection interface 151 can include a pogo pin male terminal 1511 based on a pogo pin structure and a pogo pin female terminal 1512 corresponding to the pogo pin male terminal 1511, wherein pogo pin is a precise connector used in electronic products such as mobile phones, which is widely used in semiconductor devices and mainly plays a connecting role. In the present example, the pogo pin male terminals 1511 and the pogo pin female terminals 1512 are alternately arranged on the sides of the polygonal substrate 15. Upon a pogo pin male terminal 1511 of any one illumination module 10 is plugged into the pogo pin female terminal 1512 of another illumination module, the electrical connection between the two illumination modules can be realized, and the opposite first magnetic components 111 on the two illumination modules are mutually attracted and attached.

With reference to FIG. 1 again, in an example of the present disclosure, the illumination module 10 can further include a lens fixing frame 16 for fixedly installing the lens 13, the lens fixing frame 16 is fixedly installed at the inner side of the bottom case 11 and surrounds the polygonal substrate 15, and the lens 13 is fixedly installed in the lens fixing frame 16. In addition, the lens fixing frame 16 is provided with a first groove 161 at a position corresponding to the electrical connection interface 151; and the electrical connection interface 151 is placed in the corresponding first groove 161; and the first groove 161 can protect the electrical connection interface 151 and prevent the electrical connection interface 151 from being unintentionally damaged.

In the present example, the lens fixing frame 16 and the polygonal substrate 15 can be fixedly connected to the bottom case 11 by screws. Specifically, a fixing protrusion (not shown in the figure) extending to the inner side of the lens fixing frame is provided at the bottom of the lens fixing frame 16, and screw holes (only screw holes 152 on the polygonal substrate 15 are shown in FIG. 1) are arranged at corresponding positions of the fixing protrusion, the polygonal substrate 15 and the bottom case 11. The lens fixing frame 16 and the polygon base plate 15 are fixedly installed into the bottom box 11 by using screws (not shown in the figure) which pass through the respective screw holes. The fixing protrusion can be a block-shaped protrusion, and can also be a plate-shaped protrusion extending into the lens fixing frame 16, and special description thereto is not provided in the example of the present disclosure. The way of fixedly connecting the lens fixing frame 16, the polygonal substrate 15 and the bottom case 11 by means of combining screws with screw holes listed here is only illustrative. In fact, other types of connection ways can also be used for fixing, which is not specifically limited in the example of the present disclosure.

In an example of the present disclosure, the installation manner in which the lens 13 is fixedly installed in the lens fixing frame 16 can be as follows: a plurality of buckles (not shown in the figure) are arranged at the top of the lens fixing frame 16, the edge of the lens is clamped in the buckles; and the edge of the second bottom surface 138 (referring to FIG. 6) of the lens 13 abuts against the top of the first groove 161, so as to fix the lens 13 in the lens fixing frame 16. For example, in the case where the polygonal substrate 15 is hexagonal, the lens fixing frame 16 has six side surfaces correspondingly, and at least one buckle can be arranged on the top of each side surface of the lens fixing frame 16, or the buckles can be arranged at intervals on the top of the six side surfaces of the lens fixing frame 16, so that the edge of the lens 13 can be clamped in the buckles. The fixing method of the lens 13 is simple, and is not easy to damage the lens 13, and can also facilitate the installation and disassembly of the lens 13, thereby improving the assembly efficiency of the illumination module 10.

With reference to FIG. 1 again, in an example of the present disclosure, the side wall of the bottom case 11 of the illumination module 10 can be divided into two segments, where the surface of the one segment of the side wall close to the shield 12 retreats inward and is in interference fit with the shield 12, and the bottom of the shield 12 is lapped at the joint of the two segments of the side walls, thereby the shield 12 and the bottom case 11 are buckled and fixed.

A plurality of illumination modules 10 can be spliced by using the electrical connection interfaces 151 and the first magnetic components 111 of the illumination modules 10. Therefore, in order to minimize the splicing gap between the illumination modules 10, the side surfaces of the illumination modules 10 need to be relatively flat. According to the example of the present disclosure, a second groove 113 corresponding to the first magnetic component 111 is provided on the segment of the side wall of the bottom case 11 away from the shield 12; and the second groove 113 is communicated with the segment of the side wall close to the shield 12, so that a part of the first magnetic component 111 is placed in the second groove 113, and another part of the first magnetic component 111 exposed out of the second groove 113 is placed at the segment of the side wall close to the shield 12. Furthermore, in order to ensure that the side surface of the illumination module 10 is flat, the thickness of the first magnetic component 111 is substantially the same as the depth of the second groove 113.

Figure 3:
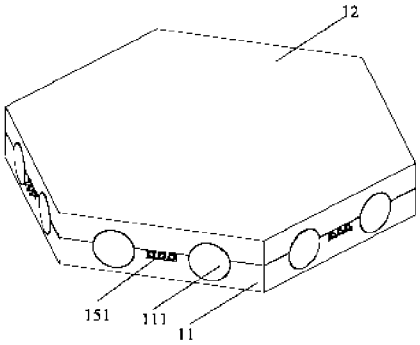
FIG. 3 shows a schematic diagram of a three-dimensional structure of an illumination module according to an example of the present disclosure.
Figure 4:
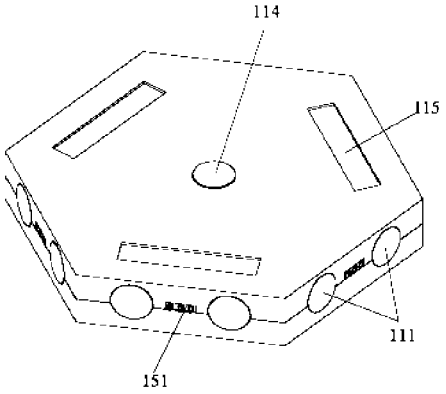
FIG. 4 shows a schematic diagram of a three-dimensional structure of an illumination module according to another example of the present disclosure.

Accordingly, the bottom of the shield 12 is recessed toward the top of the shield 12 at a position corresponding to the first magnetic component 111 to form a concave region 121; and the concave region 121 accommodates the part of the first magnetic component 111 placed at an outer side of the second groove 113. Therefore, the side surface of the shield 12, the segment of the side wall of the bottom case 11 away from the shield 12 and the exposed side surface of the first magnetic component 111 are all flush, as shown in FIG. 3 and FIG. 4.

Here, in order to further ensure the aesthetics and flatness of the side surface of the illumination module 10, the shapes of the first magnetic component 111, the concave region 121 and the second groove 113 need to be comprehensively considered. For example, in the case where the first magnetic component 111 is a circle as shown in FIGS. 1, 3 and 4, the second groove 113 is a semicircle with a diameter slightly larger than the diameter of the first magnetic component 111; and the concave region 121 is just shaped to accommodate the semicircle of the magnetic component 111 at the outer side of the second groove 113. Here, the description of the shapes of the first magnetic component 111, the concave region 121 and the second groove 113 is only illustrative, without being specifically limited in the example of the present disclosure.

In an example of the present disclosure, the number of the first magnetic components 111 installed at the outer side of each side wall of the bottom case 11 can be one, two, three, and so on. As shown in FIGS. 1, 3 and 4, two first magnet components 111 are installed at the outer side of each side wall of the bottom case 11, and the first magnetic components 111 on each side wall are located on both sides of the notch 112 of the side wall.

In addition, the installation position of the first magnetic component 111 can be arbitrary. Except the installation position of the first magnetic component 111 described above, the first magnetic component 111 can also be all arranged on the segment of the side wall of the bottom case 11 away from the shield 12. In this case, the second groove 113 may not be communicated with the segment of the side wall close to the shield 12, and the shield 12 does not need to be provided with a concave region 121. The example of the present disclosure does not limit the specific installation position of the first magnetic component 111.

In an illumination device, if an element in the illumination module 10 is to be replaced after the illumination module 10 is installed on a support body such as a wall or ceiling, etc., it is usually necessary to detach the whole illumination module 10 from the object such as the wall or ceiling, etc., and then re-install it. However, it is easy to damage the wall surface and other objects during disassembly and assembly. In order to solve this problem, in the example of the present disclosure, a second magnetic component 114 (as shown in FIG. 4) is arranged on the bottom surface of the bottom case 11, and a back plate (not shown in FIG. 4), such as an iron back plate, is installed on a support body (not shown in the figure) in advance, and then the second magnetic component 114 is attracted and attached with the back plate fixedly installed on the support body, so as to fix the illumination module onto the support body. The method of fixing the illumination module can make the assembly and disassembly convenient and effective, and the support body such as the wall surface will not be damaged in the assembly and disassembly process.

The second magnetic component 114 is round as shown in FIG. 4, but in fact, the second magnetic component 114 can also have any shape such as square or rectangle. If the illumination module 10 is heavy, in order to make the connection between the illumination module 10 and the back plate firmer, an adhesive region 115 can be reserved on the outer side of the bottom surface of the bottom case 11, and the second magnetic component 114 can be adhered to the back plate by smearing 3M glue or other types of glue on the reserved adhesive region 115.

Referring to FIG. 5 to FIG. 7*d*, in an example of the present disclosure, the lens 13 performs a front light exiting configuration for light beams emitted from the light source 14 (as shown in FIG. 1). The lens 13 includes a first incident surface 131 and a second incident surface 132 which are connected, a first total reflection surface 133 which is smoothly connected with the first incident surface 131, a second total reflection surface 134 which is smoothly connected with the second incident surface 132, a first bottom surface 137 which is smoothly connected with the first total reflection surface 133, a second bottom surface 138 which is smoothly connected with the second total reflection surface 134, a third total reflection surface 135, a fourth total reflection surface 136, a first exiting surface 139 which is smoothly connected with the third total reflection surface 135 and has a microstructure, and a second exiting surface 140 which is smoothly connected with the fourth total reflection surface 136 and has a microstructure.

The surfaces of the first incident surface 131 and the second incident surface 132 are smooth curved surfaces which are recessed back in a direction facing toward the light source 14. The surfaces of the third total reflection surface 135 and the fourth total reflection surface 136 are smooth curved surfaces which are protruding in a direction facing away from the light source 14. A part of the light beams emitted from the light source 14 enters the lens 13 through the first incident surface 131, is totally reflected by the first total reflection surface 133 and the third total reflection surface 135, and then exits from the first exiting surface 139. Another part of the light beams enters the lens 13 through the second incident surface 132, is totally reflected by the second total reflection surface 134 and the fourth total reflection surface 136, and then exits from the second exiting surface 140.

In the present example, the microstructures on the first exiting surface 139 and the second exiting surface 140 can be formed by means of techniques such as laser dotting, mold texturing, fine sand spraying, etc.; and the purpose of setting the microstructures is to prevent the light beams from continuing to be totally reflected on the exiting surface and failing to successfully exit from the lens 13. The example of the present disclosure does not specifically limit the formation process of the microstructures and the specific structure type thereof.

Figure 5:
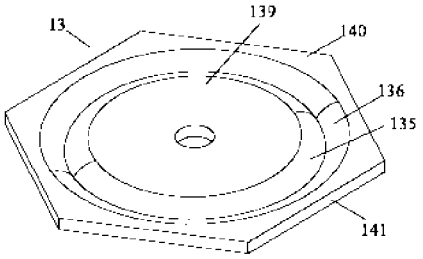
FIG. 5 shows a schematic diagram of a three-dimensional structure of a lens in an illumination module according to an example of the present disclosure.
Figure 6:
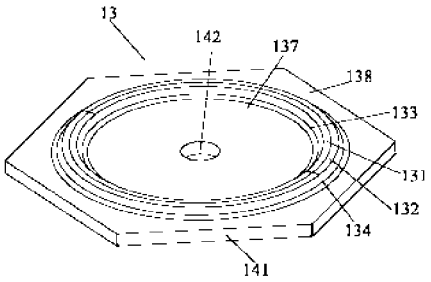
FIG. 6 shows a schematic diagram of a three-dimensional structure of the lens in the illumination module according to the example shown in FIG. 5 of the present disclosure from another perspective.
Figure 7A:
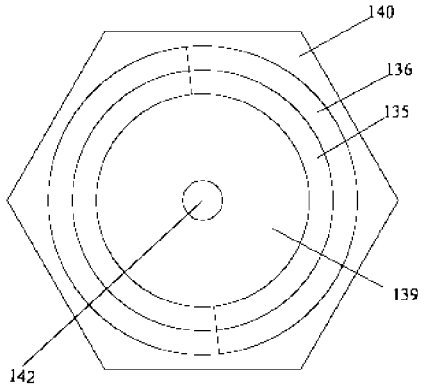
FIG. 7*a* shows a top view of the lens according to FIG. 5.
Figure 7B:
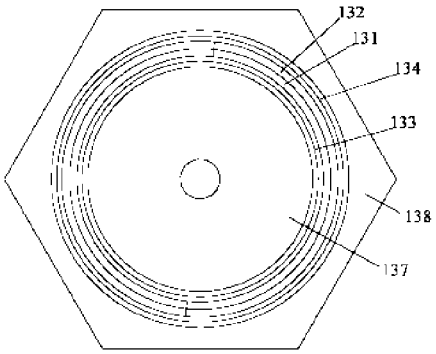
FIG. 7*b* shows a bottom view of the lens according to FIG. 5.
Figure 7C:
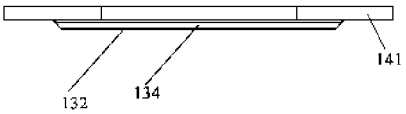
FIG. 7*c* shows a front view of the lens according to FIG. 5.
Figure 7D:
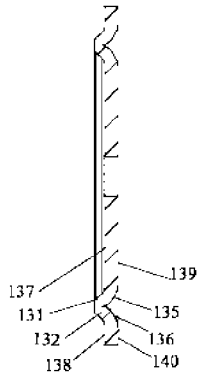
FIG. 7*d* shows a side view of the lens according to FIG. 5.

Continue to refer to FIGS. 5 and 6, in an example of the present disclosure, the first incident surface 131, the second incident surface 132, the first total reflection surface 133, the second total reflection surface 134, the third total reflection surface 135 and the fourth total reflection surface 136 are all annular surfaces, where the first total reflection surface 133 surrounds the first bottom surface 137 and the third total reflection surface 135 surrounds the first exiting surface 139. The light source 14 (as shown in FIG. 2) is located on a position of the polygonal substrate 15 (as shown in FIG. 2) corresponding to the joint of the first incident surface 131 and the second incident surface 132. For example, both the first incident surface 131 and the second incident surface 132 are annular, and the light sources 14 are arranged in a circle on the polygonal substrate 15; and the light sources 14 are arranged directly below the joint of the first incident surface 131 and the second incident surface 132.

In an example of the present disclosure, the first bottom surface 137 and the second bottom surface 138 have the same height, and a portion of the first total reflection surface 133 close to the first bottom surface 137 is on the same plane as the first bottom surface 137, a portion of the second total reflection surface 134 close to the second bottom surface 138 is on the same plane as the second bottom surface 138. The first exiting surface 139 and the second exiting surface 140 have the same height, and the edge of the second exiting surface 140 and the edge of the second bottom surface 138 have a shape corresponding to the shape of the edge of the polygonal substrate 15. For example, in the case where the polygonal substrate 15 is hexagonal, the edge of the second exiting surface 140 and the edge of the second bottom surface 138 also have six corresponding sides. Furthermore, in the present example, the second bottom surface 138 and the second exiting surface 140 are connected through a side surface 141 of the lens.

In an example of the present disclosure, a through hole 142 is further formed in the middle of the lens 13; and the through hole 142 is convenient for touching during installing the lens 13 in the illumination module 10 (as shown in FIG. 1), so as to avoid damaging the surfaces of the lens 13.

Figure 8:
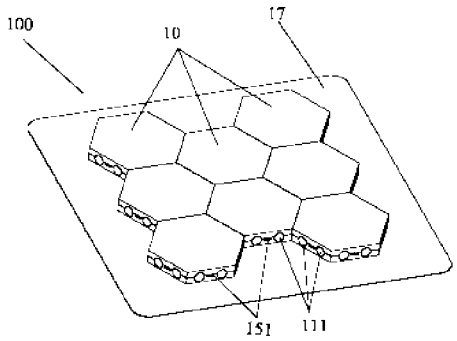
FIG. 8 shows a structural schematic diagram of an illumination device according to an example of the present disclosure.
Figure 9:
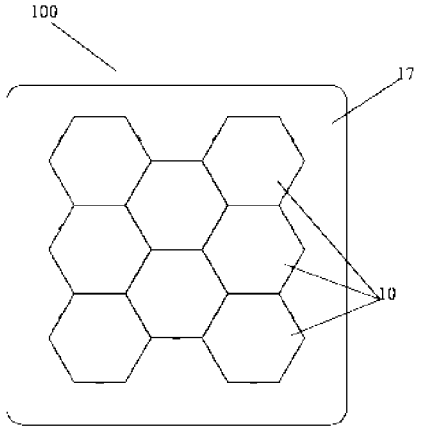
FIG. 9 shows a top view of the illumination device according to FIG. 8.

Based on the same conception, an example of the present disclosure further provides an illumination device. As shown in FIG. 8 and FIG. 9. The illumination device 100 includes at least two illumination modules 10 as described in the above examples, which are spliced together, where the first magnetic components 111 on the side walls of two adjacent bottom cases 11 in any two adjacent illumination modules 10 are mutually attracted and attached to realize a mechanical connection between the any two adjacent illumination modules 10; and at the same time, an electrical connection interface 151 of one illumination module 10 in the any two adjacent illumination modules is plugged into an electrical connection interface 151 of the other illumination module 10 in the any two adjacent illumination modules to realize an electrical connection between the any two adjacent illumination modules 10.

The illumination device 100 further includes a back plate 17 (e.g., an iron back plate, etc.) capable of being attracted and attached with a magnet. The back plate 17 is configured to fixedly mount the illumination device 100 on a support body (not shown in the figure). The bottom surface of the bottom case 11 of each illumination module 10 is provided with a second magnetic component 114 (as shown in FIG. 1). Firstly, the back plate 17 is pre-installed on a support body (e.g., a wall, a ceiling, etc.), and then, the illumination device 100 is attracted and attached onto the back plate 17 through the second magnetic component 114, thus fixing the illumination device 100 on the support body. This method of fixing the illumination device 100 can make it easy and effective to be disassembled from or be assembled onto the support body, and the support body such as the wall surface will not be damaged in the assembly and disassembly process.

In an example of the present disclosure, the illumination device 100 can further include other types of illumination modules besides the above-mentioned illumination module 10. Here, other types of illumination modules refer to different illumination modules with different lens types of illumination modules (which can achieve different light exiting effects), different light emitting colors and brightness of light sources, etc., so as to effectively meet various functional requirements of users.

The illumination devices 100 in the example of the present disclosure can be spliced into different patterns by using a plurality of illumination modules, and the patterns of the illumination devices shown in FIG. 8 and FIG. 9 are only illustrative, without being specifically limited in the example of the present disclosure.

The present disclosure provides an illumination module, an illumination device and a method of manufacturing an illumination module.

According to an aspect of the present disclosure, provided is an illumination module, including a bottom case, a shield buckled with the bottom case to form an accommodation cavity, a lens and a polygonal substrate provided with a light source which are arranged in the accommodation cavity, the lens being configured to distribute light beams emitted from the light source, where:

the bottom case has a plurality of side walls, an outer side of each of the plurality of side walls is mounted with a first magnetic component, the first magnetic component is configured to connect any two of the illumination modules by attraction; each side of the polygonal substrate is provided with an electrical connection interface, each of the plurality of side walls of the bottom case is provided with a notch, and the electrical connection interface is placed in a corresponding notch; and upon an electrical connection interface of any one illumination module being plugged into an electrical connection interface of another one illumination module, an electrical connection between the two illumination modules is realized, and the opposite first magnetic components on the two illumination modules are mutually attracted and attached.

Optionally, the electrical connection interface includes: a pogo pin male terminal based on a pogo pin structure and a pogo pin female terminal corresponding to the pogo pin male terminal, where the pogo pin male terminal and the pogo pin female terminal are alternately arranged on the sides of the polygonal substrate;

upon a pogo pin male terminal of any one illumination module is plugged into a pogo pin female terminal of another one illumination module, an electrical connection between the two illumination modules is realized, and the opposite first magnetic components on the two illumination modules are mutually attracted and attached.

Optionally, the lens performs a front light exiting configuration for light beams emitted from the light source; and the lens includes a first incident surface and a second incident surface which are connected, a first total reflection surface which is smoothly connected with the first incident surface, a second total reflection surface which is smoothly connected with the second incident surface, a first bottom surface which is smoothly connected with the first total reflection surface, a second bottom surface which is smoothly connected with the second total reflection surface, a third total reflection surface, a fourth total reflection surface, a first exiting surface which is smoothly connected with the third total reflection surface and has a microstructure, and a second exiting surface which is smoothly connected with the fourth total reflection surface and has a microstructure; where:

surfaces of the first incident surface and the second incident surface are smooth curved surfaces which are recessed back in a direction facing toward the light source; surfaces of the third total reflection surface and the fourth total reflection surface are smooth curved surfaces which are protruding in a direction facing away from the light source;

in the light beams emitted from the light source, a part of the light beams emitted from the light source enters the lens through the first incident surface, is totally reflected by the first and third total reflection surfaces, and then exits from the first exiting surface; and another part of the light beams enters the lens through the second incident surface, is totally reflected by the second and fourth total reflection surfaces, and then exits from the second exiting surface.

Optionally, the first incident surface, the second incident surface, the first total reflection surface, the second total reflection surface, the third total reflection surface and the fourth total reflection surface are all annular surfaces, where the first total reflection surface surrounds the first bottom surface and the third total reflection surface surrounds the first exiting surface;

the light source is located on a position of the polygonal substrate corresponding to a joint of the first incident surface and the second incident surface.

Optionally, the first bottom surface and the second bottom surface have a same height, and a portion of the first total reflection surface close to the first bottom surface is on a same plane as the first bottom surface, a portion of the second total reflection surface close to the second bottom surface is on a same plane as the second bottom surface;

the first exiting surface and the second exiting surface have a same height, and an edge of the second exiting surface and an edge of the second bottom surface have a shape corresponding to a shape of an edge of the polygonal substrate.

Optionally, the illumination module further includes: a lens fixing frame, fixedly installed at an inner side of the bottom case and surrounding the polygonal substrate, the lens being fixedly installed in the lens fixing frame;

a first groove is provided at a position of the lens fixing frame corresponding to the electrical connection interface, and the electrical connection interface is placed in the corresponding first groove.

Optionally, a bottom of the lens fixing frame is provided with a fixing protrusion extending to an inner side of the lens fixing frame, screw holes are arranged at corresponding positions of the fixing protrusion, the polygonal substrate and the bottom case, and screws pass through the respective screw holes to fixedly install the lens fixing frame and the polygonal substrate in the bottom case.

Optionally, a plurality of buckles are arranged at a top of the lens fixing frame, an edge of the lens is clamped in the buckles, and an edge of the second bottom surface of the lens abuts against a top of the first groove, so as to fix the lens in the lens fixing frame.

Optionally, the side wall of the bottom case is divided into two segments, where a surface of one segment of the side walls close to the shield retreats inward and is in interference fit with the shield, and a bottom of the shield is lapped at a joint of the two segments of the side walls, so that the shield and the bottom case are buckled and fixed.

Optionally, one segment of the side walls of the bottom case away from the shield is provided with a second groove corresponding to the first magnetic component, and the second groove is communicated with the one segment of the side walls close to the shield, and one part of the first magnetic component is placed in the second groove and another part of the first magnetic component is placed on the one segment of the side walls close to the shield;

the bottom of the shield is recessed toward a top of the shield at a position corresponding to the first magnetic component to form a concave region, and the concave region accommodates the part of the first magnetic component placed at an outer side of the second groove, so that a side surface of the shield, the one segment of the side walls of the bottom case away from the shield and an exposed side surface of the first magnetic component are all flush.

Optionally, a bottom surface of the bottom case is further provided with a second magnetic component, and the second magnetic component is attracted and attached with a back plate which is fixedly installed on a support body and is capable of being attracted and attached with a magnet, so as to fix the illumination module onto the support body.

According to an aspect of the present disclosure, provided is an illumination device, including at least two of the illumination modules described above, which are spliced together, where:

the first magnetic components on the side walls of two adjacent bottom cases in any two adjacent illumination modules are mutually attracted and attached to realize a mechanical connection between the any two adjacent illumination modules; and the electrical connection interface of one of the any two adjacent illumination modules is plugged into the electrical connection interface of the other one of the any two adjacent illumination modules to realize an electrical connection between the any two adjacent illumination modules.

Optionally, the illumination device further includes a back plate capable of being attracted and attached with a magnet, configured to fixedly mount the illumination device on a support body; where a bottom surface of the bottom case of each illumination module is provided with a second magnetic component; and the illumination device is attracted and attached on the back plate through the second magnetic component on each of the illumination modules, so as to be fixedly mounted on the support body.

The present disclosure also provides a method of manufacturing an illumination module. The method may include: providing a bottom case; forming an accommodation cavity by coupling a shield buckled with the bottom case; providing a lens and a polygonal substrate that are provided with a light source which are arranged in the accommodation cavity, where the lens may be configured to distribute light beams emitted from the light source; providing a plurality of side walls for the bottom case, where an outer side of each of the plurality of side walls may be mounted with a first magnetic component, and the first magnetic component is configured to connect any two of the illumination modules by attraction; providing each side of the polygonal substrate with an electrical connection interface, where each of the plurality of side walls of the bottom case may be provided with a notch, and the electrical connection interface is placed in the notch; and upon the electrical connection interface of the illumination module being plugged into an electrical connection interface of another illumination module, providing an electrical connection between the two illumination modules, and attaching the opposite first magnetic components on the two illumination modules.

The method may also include providing the electrical connection interface with a pogo pin male terminal based on a pogo pin structure and a pogo pin female terminal corresponding to the pogo pin male terminal, where the pogo pin male terminal and the pogo pin female terminal may be alternately arranged on the sides of the polygonal substrate; and upon a pogo pin male terminal of the illumination module being plugged into a pogo pin female terminal of another illumination module, providing an electrical connection between the two illumination modules, and attaching the opposite first magnetic components on the two illumination modules.

In the examples of the present disclosure, the first magnetic component is arranged on the side wall of the bottom case of the illumination modules to connect any two illumination modules by attraction, and the electrical connection interface is arranged on each side of the polygonal substrate to electrically connect any two illumination modules, so that the safe and firm electrical connection and mechanical connection of a plurality of illumination modules can be effectively realized. Furthermore, a user can assemble and disassemble the spliced illumination devices at any time, and can change the splicing pattern of the illumination devices according to individual needs of the user. Therefore, the present scheme can meet the individual needs of the user, and can improve the efficiency of assembly and disassembly of the illumination devices.

The above description is only an overview of the technical solutions of the present disclosure. In order to make the technical means of the present disclosure more obvious and understandable, the technical solutions of the present disclosure can be implemented according to the contents of the specification, and in order to make the above and other objects, features and advantages of the present disclosure more obvious and understandable, some examples of the present disclosure are given below.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

Finally, it should be noted that: for the technical solutions of the present disclosure, the above examples are illustrative but not limitative; although the present disclosure has been described in detail with reference to the aforementioned examples, those skilled in the art should understand that within the spirit and principles of the present disclosure, the technical solutions described in the aforementioned examples can still be modified, or some or all of the technical features can be equivalently substituted, and these modifications or substitutions do not make the corresponding technical solutions deviate from the protection scope of the present disclosure.

What is claimed is:

1. An illumination module, comprising a bottom case, a shield buckled coupled with the bottom case to form an accommodation cavity, a lens and a polygonal substrate provided with a light source which are arranged in the accommodation cavity, the lens being configured to distribute light beams emitted from the light source, wherein:

the bottom case has a plurality of side walls, an outer side of each of the plurality of side walls is mounted with a first magnetic component, and the first magnetic component is configured to connect any two of the illumination modules by attraction;

each side of the polygonal substrate is provided with an electrical connection interface, each of the plurality of side walls of the bottom case is provided with a notch, and the electrical connection interface is placed in the notch; and upon the electrical connection interface of the illumination module being plugged into an electrical connection interface of another illumination module, an electrical connection between the two illumination modules is realized, and the opposite first magnetic components on the two illumination modules are attached, wherein the lens comprises a third total reflection surface, a fourth total reflection surface, a first exiting surface which is smoothly connected with the third total reflection surface and has a microstructure, and a second exiting surface which is smoothly connected with the fourth total reflection surface and has a microstructure;

wherein the first exiting surface and the second exiting surface have a same height, and an edge of the second exiting surface has a shape corresponding to a shape of an edge of the polygonal substrate.

2. The illumination module according to claim 1, wherein:

the electrical connection interface comprises: a pogo pin male terminal based on a pogo pin structure and a pogo pin female terminal corresponding to the pogo pin male terminal, wherein the pogo pin male terminal and the pogo pin female terminal are alternately arranged on the sides of the polygonal substrate;

upon a pogo pin male terminal of the illumination module is plugged into a pogo pin female terminal of another illumination module, an electrical connection between the two illumination modules is realized, and the opposite first magnetic components on the two illumination modules are attached.

3. The illumination module according to claim 1, wherein the lens performs a front light exiting configuration for light beams emitted from the light source; and the lens comprises a first incident surface and a second incident surface which are connected, a first total reflection surface which is smoothly connected with the first incident surface, a second total reflection surface which is smoothly connected with the second incident surface, a first bottom surface which is smoothly connected with the first total reflection surface, and a second bottom surface which is smoothly connected with the second total reflection surface; wherein surfaces of the first incident surface and the second incident surface are smooth curved surfaces which are recessed back in a direction facing toward the light source; surfaces of the third total reflection surface and the fourth total reflection surface are smooth curved surfaces which are protruding in a direction facing away from the light source;

in the light beams emitted from the light source, a part of the light beams emitted from the light source enters the lens through the first incident surface, is totally reflected by the first and third total reflection surfaces, and then exits from the first exiting surface; and another part of the light beams enters the lens through the second incident surface, is totally reflected by the second and fourth total reflection surfaces, and then exits from the second exiting surface.

4. The illumination module according to claim 3, wherein the first incident surface, the second incident surface, the first total reflection surface, the second total reflection surface, the third total reflection surface and the fourth total reflection surface are all annular surfaces, wherein the first total reflection surface surrounds the first bottom surface and the third total reflection surface surrounds the first exiting surface;

the light source is located on a position of the polygonal substrate corresponding to a joint of the first incident surface and the second incident surface.

5. The illumination module according to claim 3, wherein the first bottom surface and the second bottom surface have a same height, and a portion of the first total reflection surface close to the first bottom surface is on a same plane as the first bottom surface, and a portion of the second total reflection surface close to the second bottom surface is on a same plane as the second bottom surface;

an edge of the second bottom surface have a shape corresponding to the shape of the edge of the polygonal substrate.

6. The illumination module according to claim 5, further comprising:

a lens fixing frame, fixedly installed at an inner side of the bottom case and surrounding the polygonal substrate, the lens being fixedly installed in the lens fixing frame;

wherein a first groove is provided at a position of the lens fixing frame corresponding to the electrical connection interface, and the electrical connection interface is placed in the corresponding first groove.

7. The illumination module according to claim 6, wherein a bottom of the lens fixing frame is provided with a fixing protrusion extending to an inner side of the lens fixing frame, screw holes are arranged at corresponding positions of the fixing protrusion, the polygonal substrate and the bottom case, and screws pass through the respective screw holes to fixedly install the lens fixing frame and the polygonal substrate in the bottom case.

8. The illumination module according to claim 6, wherein a plurality of buckles are arranged at a top of the lens fixing frame, an edge of the lens is clamped in the buckles, and an edge of the second bottom surface of the lens abuts against a top of the first groove, so as to fix the lens in the lens fixing frame.

9. The illumination module according to claim 1, wherein the side wall of the bottom case is divided into two segments, wherein a surface of one segment of the side walls close to the shield retreats inward and is in interference fit with the shield, and a bottom of the shield is lapped at a joint of the two segments of the side walls, so that the shield and the bottom case are buckled and fixed.

10. The illumination module according to claim 9, wherein one segment of the side walls of the bottom case away from the shield is provided with a second groove corresponding to the first magnetic component, and the second groove is communicated with the one segment of the side walls close to the shield, and one part of the first magnetic component is placed in the second groove and another part of the first magnetic component is placed on the one segment of the side walls close to the shield;

the bottom of the shield is recessed toward a top of the shield at a position corresponding to the first magnetic component to form a concave region, and the concave region accommodates the part of the first magnetic component placed at an outer side of the second groove, so that a side surface of the shield, the one segment of the side walls of the bottom case away from the shield and an exposed side surface of the first magnetic component are flush.

11. The illumination module according to claim 1, wherein a bottom surface of the bottom case is further provided with a second magnetic component, and the second magnetic component is attached with a back plate which is fixedly installed on a support body and is capable of being attached with a magnet, so as to fix the illumination module onto the support body.

12. An illumination device, comprising at least two illumination modules, wherein one illumination module of the at least two illumination modules comprises: a bottom case, a shield buckled coupled with the bottom case to form an accommodation cavity, a lens and a polygonal substrate provided with a light source which are arranged in the accommodation cavity, the lens being configured to distribute light beams emitted from the light source, wherein:

the bottom case has a plurality of side walls, an outer side of each of the plurality of side walls is mounted with a first magnetic component, and the first magnetic component is configured to connect any two of the illumination modules by attraction;

each side of the polygonal substrate is provided with an electrical connection interface, each of the plurality of side walls of the bottom case is provided with a notch, and the electrical connection interface is placed in the notch;

upon the electrical connection interface of the illumination module being plugged into an electrical connection interface of another illumination module, an electrical connection between the two illumination modules is realized, and the opposite first magnetic components on the two illumination modules are attached; and the at least two illumination modules are spliced together, wherein:

the first magnetic components on the side walls of two adjacent bottom cases in any two adjacent illumination modules are mutually attached to realize a mechanical connection between the any two adjacent illumination modules; and the electrical connection interface of one of the any two adjacent illumination modules is plugged into the electrical connection interface of the other one of the any two adjacent illumination modules to realize an electrical connection between the any two adjacent illumination modules, wherein the lens comprises a third total reflection surface, a fourth total reflection surface, a first exiting surface which is smoothly connected with the third total reflection surface and has a microstructure, and a second exiting surface which is smoothly connected with the fourth total reflection surface and has a microstructure;

wherein the first exiting surface and the second exiting surface have a same height, and an edge of the second exiting surface has a shape corresponding to a shape of an edge of the polygonal substrate.

13. The illumination device according to claim 12, wherein the illumination device further comprises:

a back plate capable of being attached with a magnet, wherein the back plate is configured to fixedly mount the illumination device on a support body; a bottom surface of the bottom case of each illumination module is provided with a second magnetic component; and the illumination device is attached on the back plate through the second magnetic component on each of the illumination modules, so as to be fixedly mounted on the support body.

14. The illumination device according to claim 12, wherein:

the electrical connection interface comprises: a pogo pin male terminal based on a pogo pin structure and a pogo pin female terminal corresponding to the pogo pin male terminal, wherein the pogo pin male terminal and the pogo pin female terminal are alternately arranged on the sides of the polygonal substrate;

upon a pogo pin male terminal of the illumination module is plugged into a pogo pin female terminal of another illumination module, an electrical connection between the two illumination modules is realized, and the opposite first magnetic components on the two illumination modules are attached.

15. The illumination device according to claim 12, wherein the lens performs a front light exiting configuration for light beams emitted from the light source; and the lens comprises a first incident surface and a second incident surface which are connected, a first total reflection surface which is smoothly connected with the first incident surface, a second total reflection surface which is smoothly connected with the second incident surface, a first bottom surface which is smoothly connected with the first total reflection surface, and a second bottom surface which is smoothly connected with the second total reflection surface;

surfaces of the first incident surface and the second incident surface are smooth curved surfaces which are recessed back in a direction facing toward the light source; surfaces of the third total reflection surface and the fourth total reflection surface are smooth curved surfaces which are protruding in a direction facing away from the light source;

in the light beams emitted from the light source, a part of the light beams emitted from the light source enters the lens through the first incident surface, is totally reflected by the first and third total reflection surfaces, and then exits from the first exiting surface; and another part of the light beams enters the lens through the second incident surface, is totally reflected by the second and fourth total reflection surfaces, and then exits from the second exiting surface.

16. The illumination device according to claim 15, wherein the first incident surface, the second incident surface, the first total reflection surface, the second total reflection surface, the third total reflection surface and the fourth total reflection surface are all annular surfaces, wherein the first total reflection surface surrounds the first bottom surface and the third total reflection surface surrounds the first exiting surface;

the light source is located on a position of the polygonal substrate corresponding to a joint of the first incident surface and the second incident surface.

17. A method of manufacturing an illumination module, comprising providing a bottom case;

forming an accommodation cavity by coupling a shield buckled with the bottom case; providing a lens and a polygonal substrate that are provided with a light source which are arranged in the accommodation cavity, wherein the lens is configured to distribute light beams emitted from the light source;

providing a plurality of side walls for the bottom case, wherein an outer side of each of the plurality of side walls is mounted with a first magnetic component, and the first magnetic component is configured to connect any two of the illumination modules by attraction; providing each side of the polygonal substrate with an electrical connection interface, wherein each of the plurality of side walls of the bottom case is provided with a notch, and the electrical connection interface is placed in the notch;

upon the electrical connection interface of the illumination module being plugged into an electrical connection interface of another illumination module, providing an electrical connection between the two illumination modules, and attaching the opposite first magnetic components on the two illumination modules; and providing a third total reflection surface, a fourth total reflection surface, a first exiting surface which is smoothly connected with the third total reflection surface and has a microstructure, and a second exiting surface which is smoothly connected with the fourth total reflection surface and has a microstructure in the lens, wherein the first exiting surface and the second exiting surface have a same height, and an edge of the second exiting surface has a shape corresponding to a shape of an edge of the polygonal substrate.

18. The method of manufacturing the illumination module illumination module according to claim 17, further comprising:

providing the electrical connection interface with a pogo pin male terminal based on a pogo pin structure and a pogo pin female terminal corresponding to the pogo pin male terminal, wherein the pogo pin male terminal and the pogo pin female terminal are alternately arranged on the sides of the polygonal substrate; and upon a pogo pin male terminal of the illumination module being plugged into a pogo pin female terminal of another illumination module, providing an electrical connection between the two illumination modules, and attaching the opposite first magnetic components on the two illumination modules.

* * * * *